US006443832B1

(12) United States Patent
de Barros et al.

(10) Patent No.: US 6,443,832 B1
(45) Date of Patent: Sep. 3, 2002

(54) ONE-PIECE VENT AND EXHAUST DOOR FOR AN AIR CONDITIONER

(75) Inventors: Daniel Alessandro Oliveira de Barros, Novo Hamburgo; Gilberto Fagundez de Souza, Porto Alegre; Paulo Augusto Lisboa Ramos, Esteio, all of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/743,542

(22) PCT Filed: May 28, 1999

(86) PCT No.: PCT/BR99/00039

§ 371 (c)(1),
(2), (4) Date: May 30, 2001

(87) PCT Pub. No.: WO00/73708

PCT Pub. Date: Dec. 7, 2000

(51) Int. Cl.[7] ..... E06B 7/02
(52) U.S. Cl. ..... 454/202; 62/410
(58) Field of Search ..... 454/202, 237, 454/251, 201; 62/262, 410

(56) References Cited

U.S. PATENT DOCUMENTS 3,194,027 A * 7/1965 Prendergast et al. ..... 62/262
3,411,311 A * 11/1968 Wegman ..... 62/262
3,785,166 A * 1/1974 Schrader ..... 62/227
3,823,574 A 7/1974 Bolton ..... 62/262
5,010,742 A 4/1991 Bolton et al. ..... 62/262
5,056,333 A * 10/1991 Cho ..... 62/262

FOREIGN PATENT DOCUMENTS

DE 4039164 6/1991
EP 58133538 9/1983

* cited by examiner

*Primary Examiner*—Harold Joyce
*Assistant Examiner*—Derek S. Boles

(57) ABSTRACT

A room air conditioner of the type having a partition dividing indoor and outdoor sections is provided with vent and exhaust openings for exhausting air into the outdoor section and for venting outdoor air into the indoor section. A combination vent and exhaust door is mounted on the partition in the outdoor section. The combination vent and exhaust door is configured to be selectively operable to a first position wherein the vent opening is closed and the exhaust opening is open, a second position wherein both the vent opening and the exhaust opening are closed and a third position wherein the vent opening is open and the exhaust opening is closed. An actuator mechanism is mechanically linked to the combination door for selectively operating the door to each of the three positions.

3 Claims, 8 Drawing Sheets

ONE-PIECE VENT AND EXHAUST DOOR FOR AN AIR CONDITIONER

TECHNICAL FIELD

This invention relates generally to air conditioning units and, more particular, to a one-piece vent and exhaust door of a room air conditioner and means for actuating such door.

BACKGROUND ART

A room air conditioner is a self-contained unit having outdoor and indoor sections, which are divided by a transversely extending partition wall. The outdoor section includes a condenser coil and a fan for circulating outdoor air through the condenser coil and a fan fir circulating outdoor air through the condenser coil to thereby cool the refrigerant flowing through the system. The indoor section includes an evaporator coil an a blower which draws in the relatively warm room air, passes it through the evaporator coil to be cooled, and then discharges the cooled air back into the room.

Rather than continuously recirculating the same room air, it is sometimes desirable to exhaust some of the stale room air to the outside. Further, it may be desirable, especially in cooler ambient temperature conditions, to bring in the outdoor air for distribution into the room. These functions have traditionally been accomplished with the use of exhaust vent ports, respectively, which, when opened, allow the selective flow of air between the outdoor and indoor sections. The doors are commonly located in strategic positions so as to take advantage of the pressure differences to selectively cause the outdoor air to flow through the vent port into the indoor section or for the indoor air to flow through the exhaust port to the outdoor section.

Since the pressure differences are normally sufficient only for one or the other of the vent and exhaust functions but not for both simultaneously, it has become common practice to provide a single selector mechanism to operate both devices, with a single handle operating to open one door at a time. However, because of the need to locate the two doors in different locations, as required by the pressure drop needs discussed hereinabove, the control mechanism has normally been mounted on a different component from one or both of the doors. In some cases, even the vent and exhaust doors are mounted on different components. Typical of such devices is that shown in U.S. Pat. No. 3,823,574 assigned to the assignee of the present invention. While effective, these devices have been relatively complex and have traditionally involved a relatively large number of interconnecting parts. Thus, besides the obvious disadvantages of complicating the assembly and operation processes, the proper spatial interrelationships between the various parts have been found to be somewhat difficult to establish and maintain. That is, not only is there a tolerance stackup from the combination of he numerous parts, but the difficulties in maintaining proper alignment in operation are exacerbated by the fact that these various components are attached to different mounting members whole relative positions are difficult to control. For example, in the system described in the above-mentioned patent, the doors are mounted to the partition but the operating levers are mounted to the control box. Since the position of the control box relative to the partition may vary, it may lead to an improper fit or operation of the control mechanism interconnecting the lever and the doors.

U.S. Pat. No. 5,010,742, Actuation Mechanism For Vent And Exhaust Doors, is assigned to the assignee of the present invention. The '742 patent discloses a room air conditioner having a scroll having vent and exhaust openings formed therewith. A vent door and an exhaust door are provided for selectively opening or closing the vent and exhaust openings. An actuator mechanism mounted to the scroll is mechanically linked to the vent and exhaust doors to provide the selective operation. While the '742 patent strives to reduce the number of components in the system, it requires cam mechanisms, springs, and other connecting devices in order to coordinate the selective opening and closing of the doors. Accordingly, it continues to be desirable to minimize the number of components in and, accordingly, the cost of air conditioning units having both vent and exhaust capabilities.

DISCLOSURE OF THE INVENTION

A room air conditioner of the type having a partition dividing indoor and outdoor sections is provided with vent and exhaust openings for exhausting air into the outdoor section and for venting outdoor air into the indoor section. A combination vent and exhaust door is mounted on the partition in the outdoor section. The combination vent and exhaust door is configured to be selectively operable to a first position wherein the vent opening is closed and the exhaust opening is open, a second position wherein both the vent opening and the exhaust opening are closed and a third position wherein the vent opening is open and the exhaust opening is closed. An actuator mechanism is mechanically linked to the combination door for selectively operating the door to each of the three positions.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
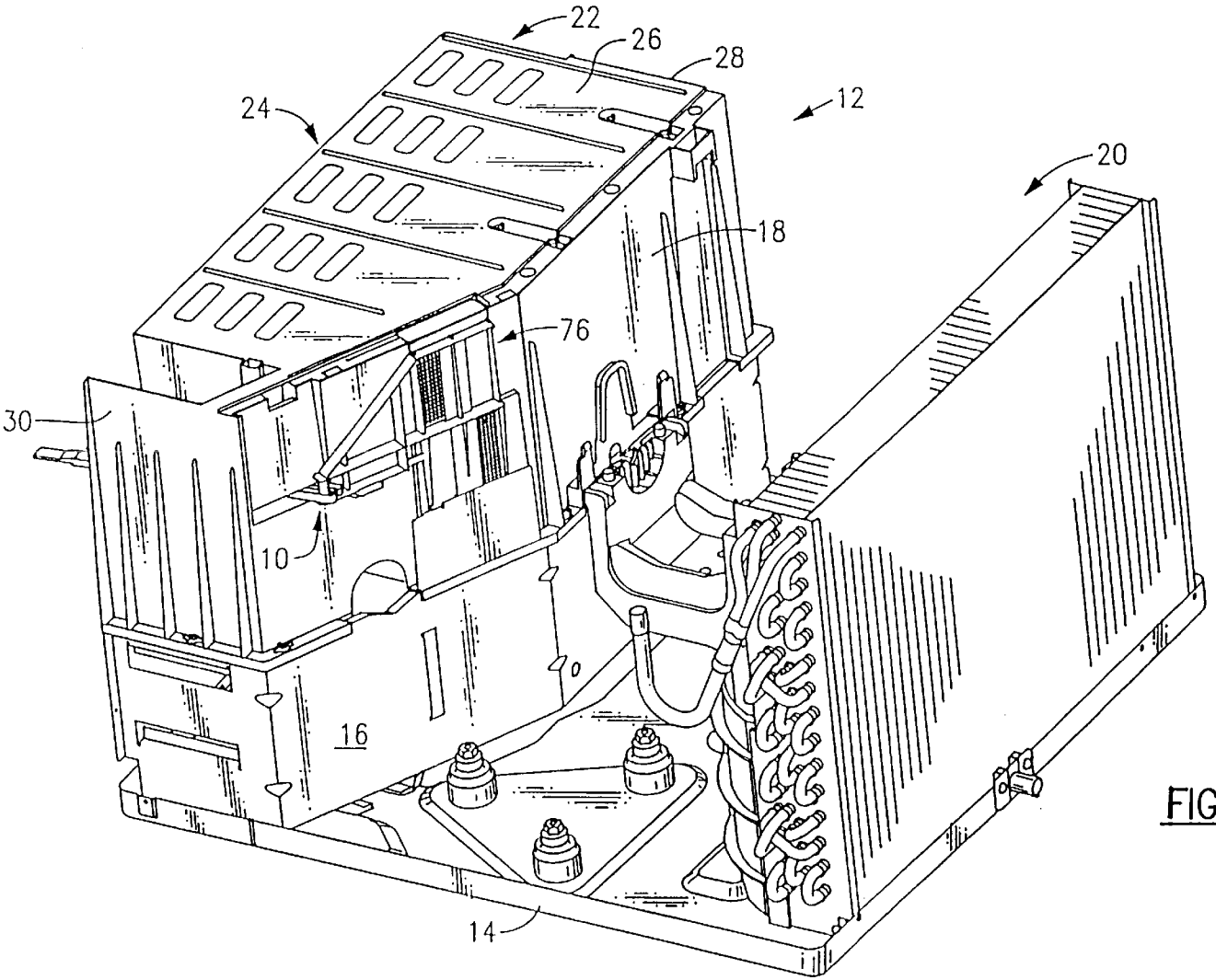
FIG. 1 is a rear perspective view of an air conditioning unit embodying the present invention, with the outer cover and a number of internal components removed therefrom to facilitate showing illustration of the invention.

Referring first to FIG. 1, the invention is shown, generally, at 10 as embodied in a window room air conditioner 12. The outer cover and many of the outdoor components of the window room air conditioner are not shown in order to facilitate illustration of the invention. The air conditioner 12 includes a basepan 14, which is divided by a vertically extending partition having a lower section 16 and an upper section 18 to define the boundaries between the outdoor and indoor sections 20 and 22, respectively, of the air conditioner.

The upper section 18 of the partition forms a part of a large molded plastic component 24, which includes a top 26 and left and right side walls 28 and 30, respectively.

Figure 3:
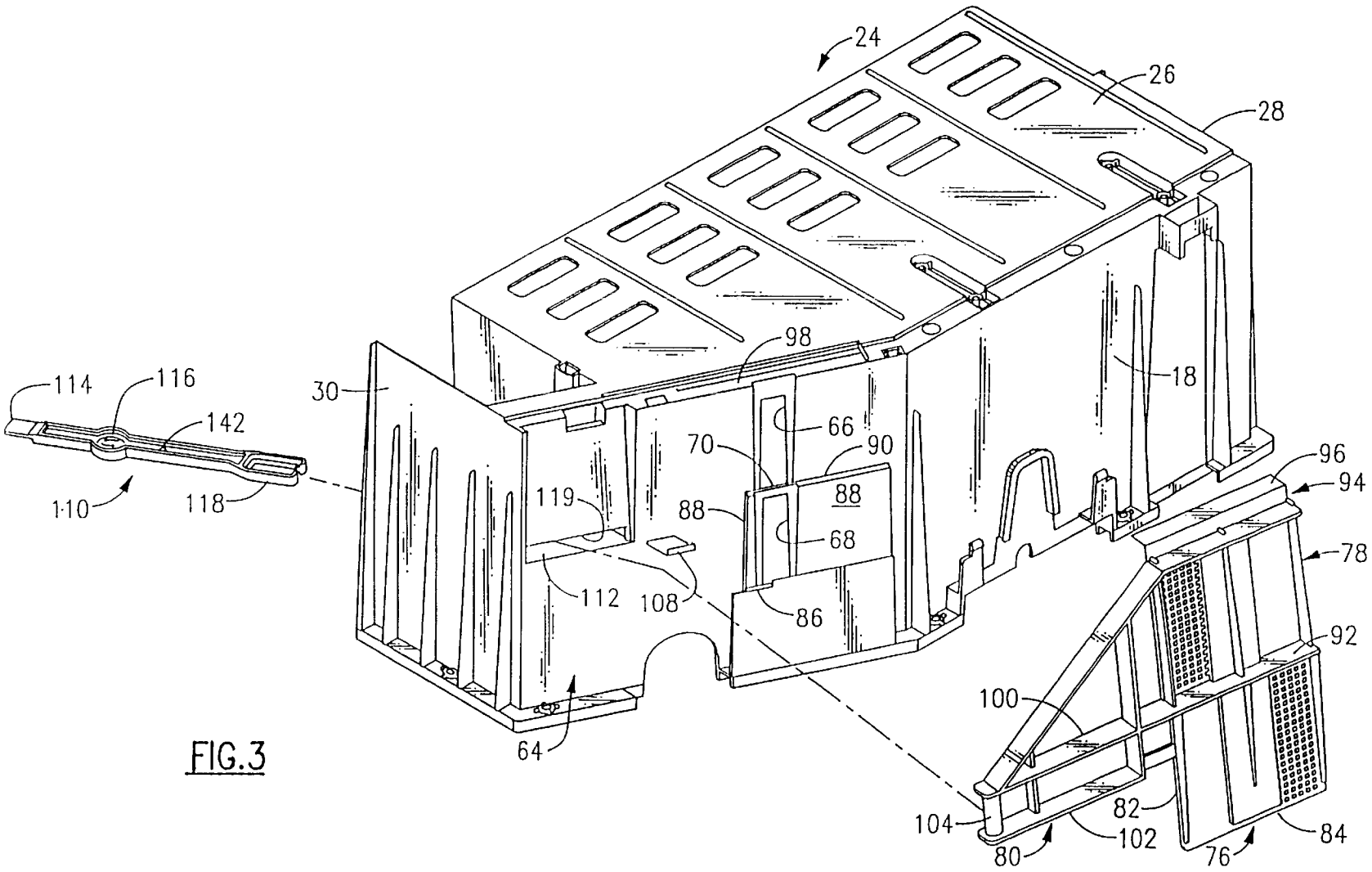
FIG. 3 is a perspective view of the upper cover/partition structure with the door and actuating lever of the present invention exploded therefrom.
Figure 4:
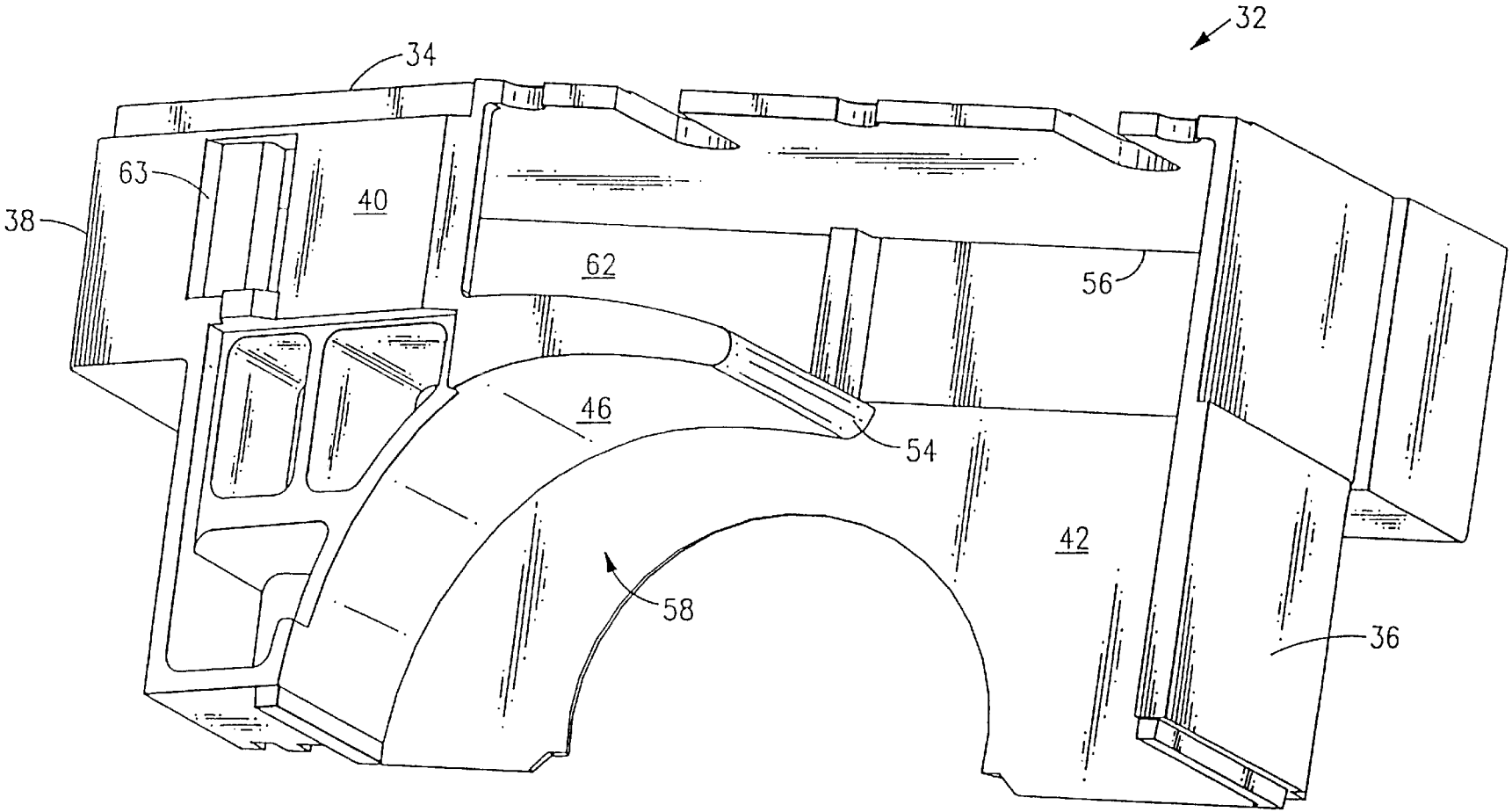
FIG. 4 is a rear perspective view of the scroll of the air conditioning unit of FIG. 1.
Figure 5:
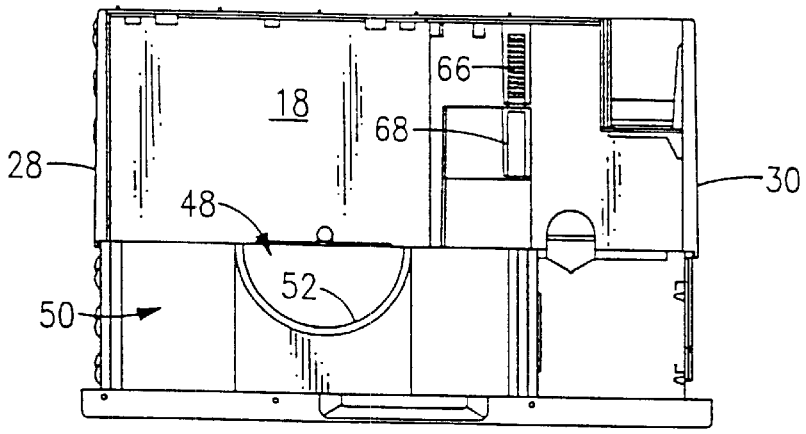
FIG. 5 is front view of the air conditioning unit of FIG. 1 with the evaporator coil and scroll removed therefrom showing the vent door and actuating mechanism in the exhaust position.
Figure 6:
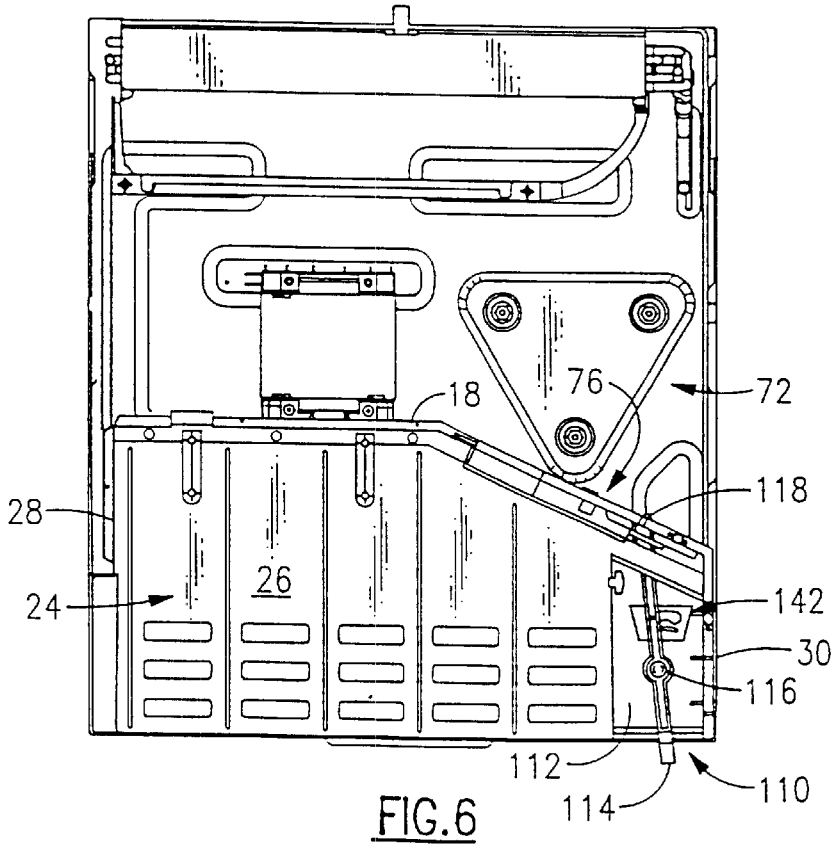
FIG. 6 is a top plan view of the unit as shown in FIG. 5.
Figure 7:
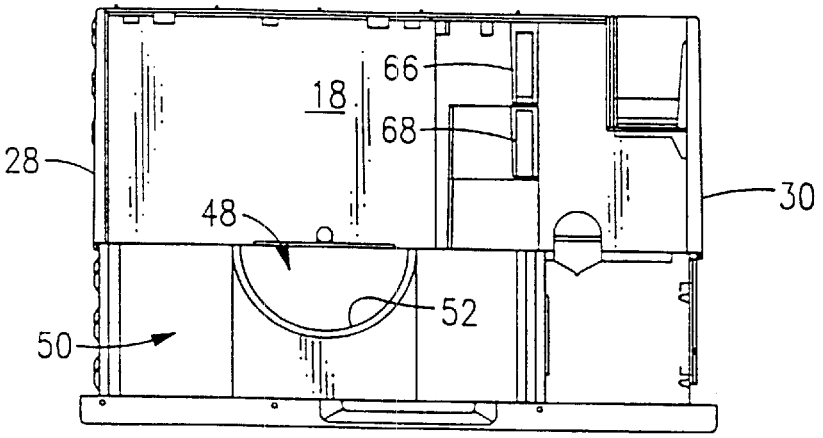
FIGS. 7 and 8 are views similar to FIGS. 5 and 6 showing the vent door and actuating mechanism in the closed condition.
Figure 8:
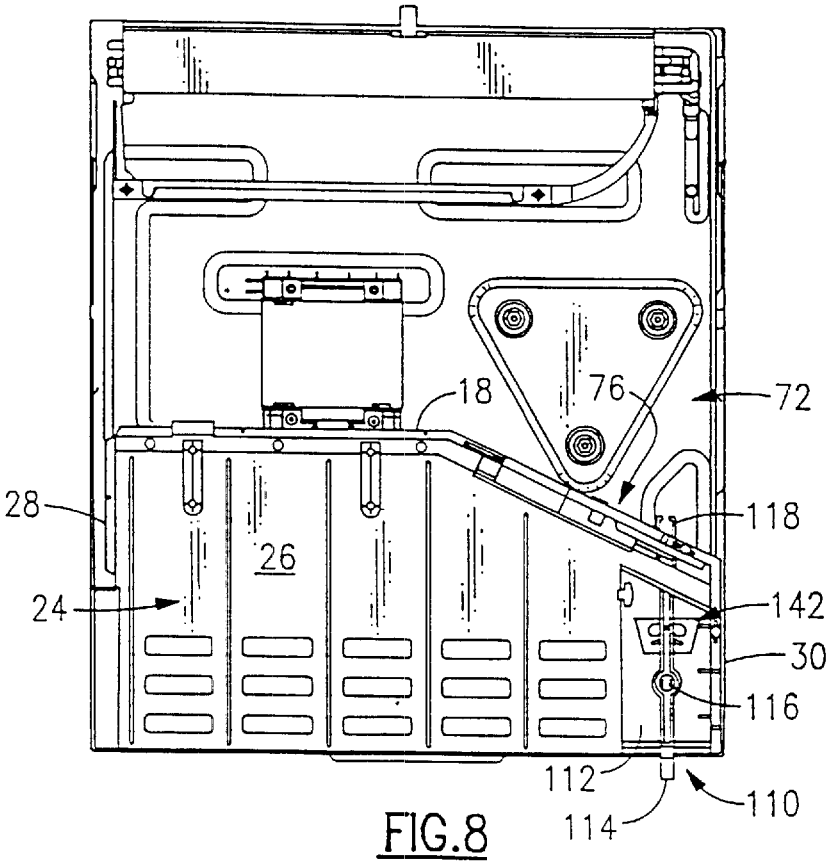
Figure 9:
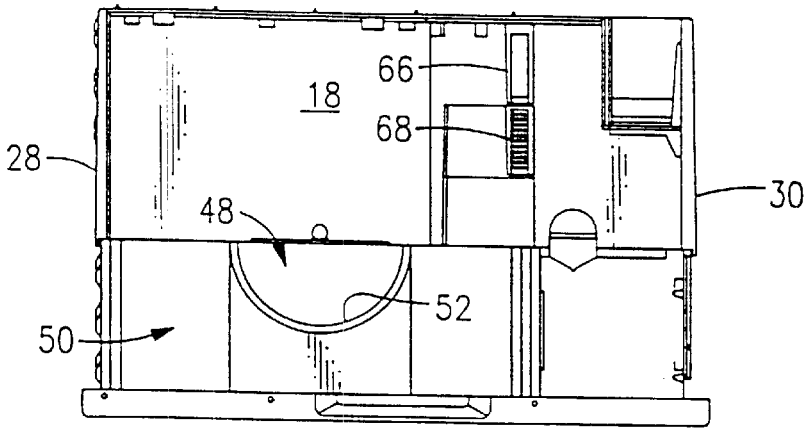
FIGS. 9 and 10 are views similar to FIGS. 5 and 6 showing the vent door and actuating mechanism in the vent open condition.

It should be appreciated that FIGS. 1 through 4 illustrate the air conditioner from the back side, while FIGS. 5 through 10 illustrate the air conditioner in the more conventional orientation from the front thereof. The conventions left and right will be adopted with respect to viewing the air conditioner from the front, i.e. as illustrated in FIGS. 5, 7 and 9, accordingly the left and right sides, as viewed in FIGS. 1 through 4 will be reversed.

Figure 11:
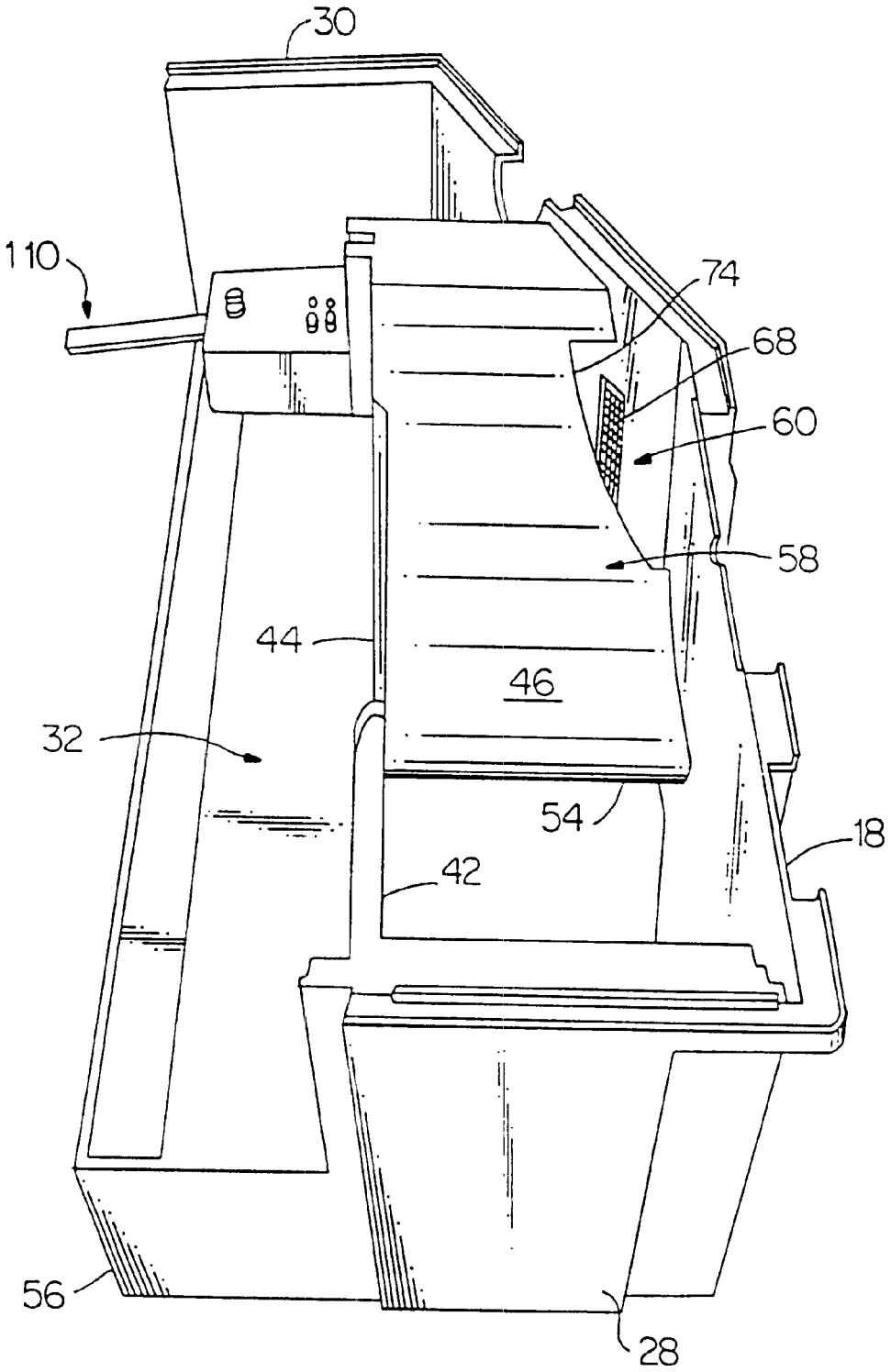
FIG. 11 is a bottom perspective view of the assembly of the upper partition and the scroll.

The large plastic component 24 cooperates with the upper part of a scroll structure 32, which is best shown in FIGS. 4 and 11. The upper scroll structure 32 includes a planar top 34, left and right end walls 36 and 38, respectively, and a small rear wall section 40 adjacent the right end wall 38. A downwardly extending intermediate wall 42 having a semi-circular opening 44 therein cooperates with a curved wall section 46 to define an upper scroll chamber 58 which in turn cooperates with a lower scroll chamber 48 formed by a lower scroll structure 50, which is illustrated in FIGS. 5, 7 and 9. The lower scroll structure 50 includes semi-circular opening 52, which cooperates with the opening 54 of the upper scroll structure to form the evaporator blower orifice. A blower wheel (not shown) is rotatably disposed within the upper and lower scroll chambers 58 and 48. The blower wheel has its axis aligned with that of the orifice formed by the openings 44 and 52.

In operation, the blower wheel is rotated by its driving motor to draw return air from the room and cause it to flow through the evaporator coil to be cooled and then through the orifice and into the fan where it is then directed radially outwardly and upwardly through a passage defined by the edge 54 of the curved wall 46 and the interior of the left end wall 36 to an elongated rectangular shaped fan discharge structure 56, through which cooled air is delivered to the room being cooled.

It should be recognized that when the blower is in operation, a relatively low pressure condition will exist in the indoor section on the evaporator coil side of the upper partition section 18 in the region generally adjacent the upper scroll chamber 58, which low pressure area is indicated by the numeral 60 in FIG. 11. Conversely, within another portion of the indoor section, i.e. on the discharge side of the blower, an area of relatively high pressure will exist within the fan discharge structure 56. That high pressure area is indicated generally by the numeral 62, as best seen in FIG. 4.

A rectangular exhaust flow opening 66 extends through the rear wall 40 of the scroll, which communicates the high pressure area 62 with the back of the scroll. Looking now at FIGS. 3 and 5 through 10, a planar section 64 of the upper partition 18 is provided with a vertically extending rectangular exhaust opening 66 near the upper end thereof and an identically shaped vent opening 68 directly underlying the exhaust opening and spaced therefrom by a horizontal spacer 70. During operation of the air conditioner 12, the region in the outdoor section adjacent the openings 66 and 68 generally indicated by reference numeral 72 is at a pressure which is higher than the low pressure region 60 and lower than the high pressure region 62. The selective opening and closing of the openings 66 and 68 is accomplished by operation of the present invention, as will be described in detail hereinbelow.

It should be appreciated, however, that when air flow is allowed through the exhaust opening 66, air flows from the high pressure region 62 within the air discharge structure 56 through the exhaust openings 63 in the scroll, through the exhaust opening 66 in the wall 64 and into the outdoor section 20. In a like manner, when the vent opening 68 is open for free air flow therethrough, outdoor air from the outdoor section will pass to the low pressure region 60 by passing from the relatively high pressure region 72 in the outdoor section through the vent opening 68 into the low pressure region 60 and thence through an arcuately shaped cut-out 74 formed in the curved wall 46 of the upper scroll structure 32 where it mixes with the cooled air, which has passed through the evaporator and is directed into the room by the fan through the flow path described above and outwardly through the air discharge 56.

Referring now to FIGS. 2, 3 and 5 through 10, a one-piece combination exhaust and vent door 76 is shown, which is actuatable to selectively allow vent or exhaust or no flow through either of the exhaust or vent systems by selectively blocking or allowing flow through the exhaust and vent openings 66 and 68. The one-piece door 76 comprises a rectangularly shaped planar wall section 78 and an actuating arm 80 integrally formed with the right-hand edge 82 of the wall section and extending to the right thereof (using the above set forth left right conventions). The wall 78 has a lower edge 84, which is adapted to be slidably received in a horizontally extending slot 86 formed in the wall 64 adjacent the lower end of the vent opening 68.

As best seen in FIG. 3, the planar section 64 of the partition 18 has raised sections thereof 88 extending from the horizontal slot 86 on opposite sides of the vent opening 68 and which terminate in a horizontally extending upwardly facing ledge 90, which extends parallel to the slot 86. The rectangular wall 78 of the door 76 has a horizontally extending rib 92, which has formed on the back side thereof a downwardly facing surface (not shown), which is adapted to rest on the ledge 90 and allows horizontal translation of the one-piece door assembly therewith. Extending from the top of the wall 78 is an L-shaped flange 94, which defines a horizontal leg 96 which is adapted to engage a horizontally extending support surface 98 at the top of the planar wall section 64. This support structure also allows free horizontal translation of the door assembly 76.

The actuating arm 80 includes a first horizontally extending section 100, which is an extension of the horizontal rib 92. A second horizontal section 102 extends from the right edge 82 of the wall and is spaced from and parallel to the first section 100. Extending between the right-hand ends of the sections 100 and 102 is an actuator engaging element 104, which has a circular cross-section thereto. A diagonal support section and several vertically extending support sections, generally 106, serve to structurally interconnect the horizontal sections 100, 102 and the right edge 82. An actuator arm support 108 is integrally molded into the wall 64 and is adapted to receive the lower arm 102 therein in a manner which will allow horizontal translation therewith while providing vertical and horizontal restraint and support to the actuating arm 80.

Figure 2:
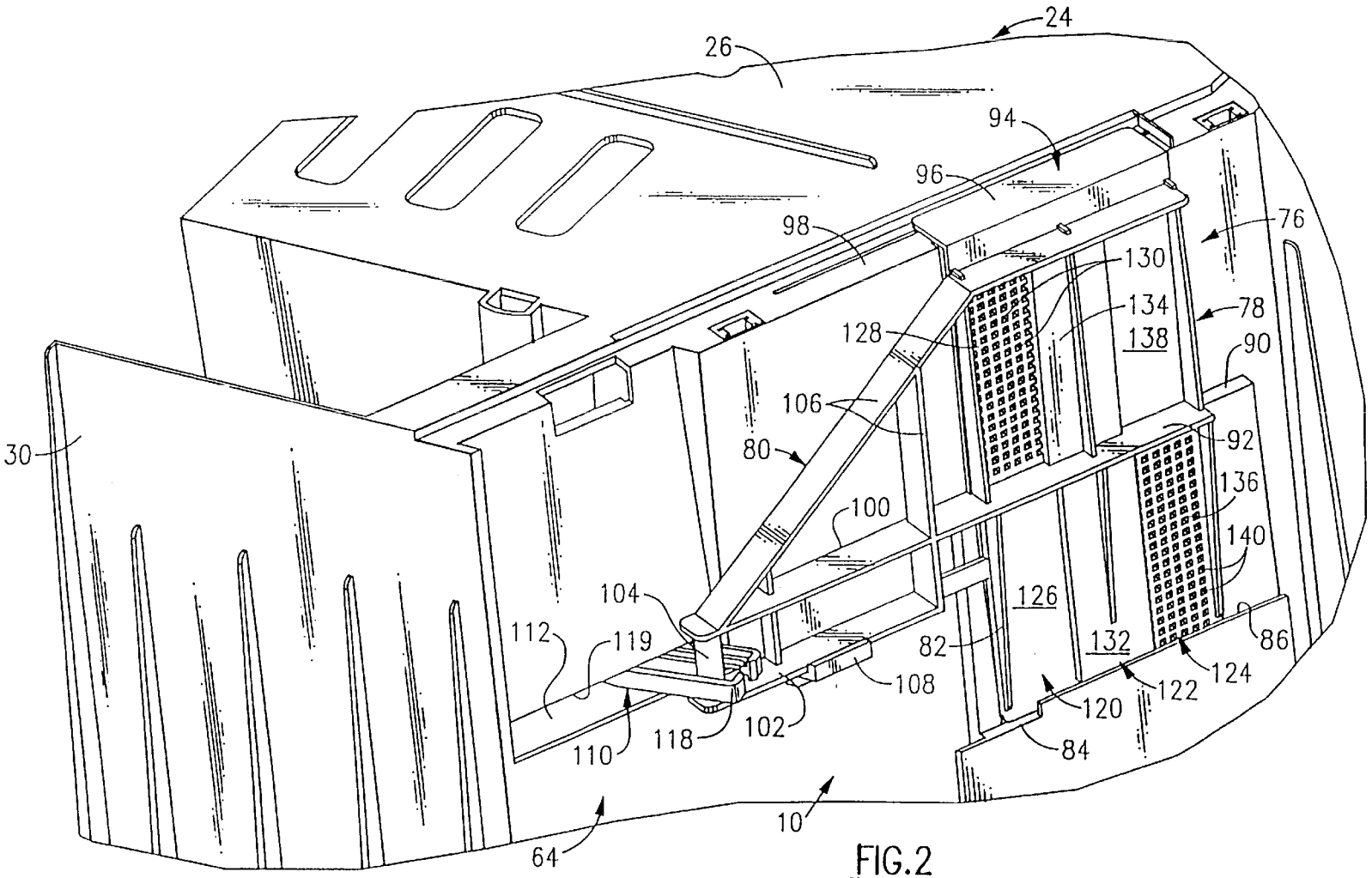
FIG. 2 is an enlarged view similar to FIG. 1 of the vent of the present invention.
Figure 10:
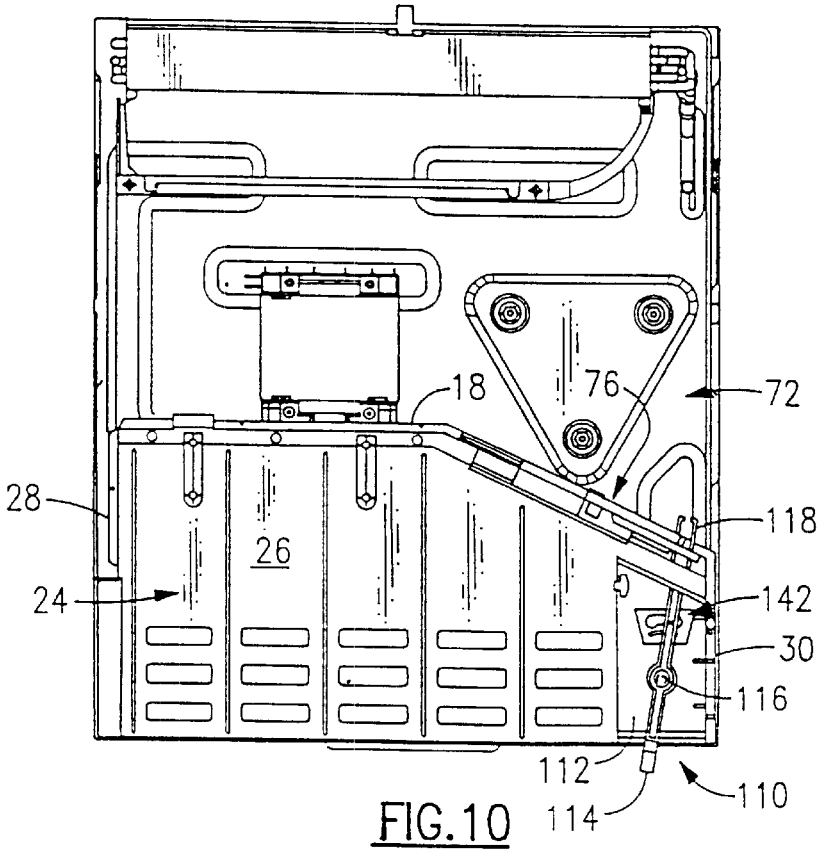

With continued reference to FIGS. 2, 3 and 6 through 10, an elongated actuating lever 110 is supported on a horizontal structural surface 112 formed in the molded plastic component 24 to the left of the right-hand side wall 30. The lever has an outer end 114 to be engaged by the operator for manual adjustment of the vent/exhaust door 76. The lever is pivotally mounted at an intermediate point 116 to the horizontal support and terminates in an elongated forked end 118, which extends through a horizontally extending opening 119 in the partition wall 64. The forked end 118 is configured to engage the circular cross-section element 104 at the end of the actuating arm 80. As so configured, with the one-piece door 76 mounted as illustrated in FIG. 2 actuation of the outer end 114 of the actuating lever 110 will result in horizontal translation of the forked end 118 and translation of such motion to the one-piece door. When such translation occurs, the door remains in confronting relation with the planar wall 64 and the exhaust and vent opening 66 and 68 as the circular element 106 translates through the elongated opening in the forked end 118. As best seen in FIGS. 6, 8 and 10, a cooperating detent structure 142 is provided on the actuating lever 110 and the horizontal surface 112 to hold the arm in each of the selected positions.

The operation of the one-piece door 76 to selectively close off and open the exhaust 66 and vent 68 openings will best be understood by describing the rectangular wall 78 of the door as three sections, which correspond to three operating positions of the actuating lever 110 and the door assembly 76. The three sections, as best seen in FIGS. 2 and 3, have been given reference numerals 120, 122 and 124, and each comprises a substantially rectangular upper and lower region, in overlying relationship with one another so that each of the first, second and third sections, 120, 122 and 124, defines a discrete vertically extending section of the wall 78.

Looking now at the first section 120, the lower region 126 is solid and will not allow the flow of air therethrough, the upper region 128 is provided with a plurality of openings 130 therethrough, which will allow air flow therethrough. The second section 122 has lower and upper sections 132 and 134, which are both solid and will not allow the flow of air therethrough. The third section 124 has an upper section 138, which is solid and will not allow air flow therethrough and a lower section 136, which has a plurality of openings 140 therethrough, which will allow the free flow of air.

As pointed out above, the exhaust/vent system 10 of the present invention is operable between three positions. A first position which will allow exhausting, a second position which will allow neither vent nor exhaust, and a third position which will allow venting. FIGS. 2, 5 and 6 illustrate the invention 10 in the first or exhaust position. In this position, the upper section 128 of the first wall section 120 overlies the exhaust opening 66 thereby allowing free flow of air through the exhaust system, as described above. At the same time, the lower solid region 126 of the first wall section 120 overlies the vent opening 68 thereby precluding flow through the vent flow path.

The second operating position is illustrated in FIGS. 7 and 8 wherein the outer end 114 of the actuating lever 110 has been moved from the position to the right, as viewed in FIG. 6, to a central position, as viewed in FIG. 8, thereby horizontally displacing the one-piece door 76 to the position illustrated in FIGS. 7 and 8 where the upper and lower regions 132 and 134 of the second section 122 are in overlying relationship with the exhaust opening and 66 and the vent opening 68, respectively, thereby precluding flow of air through either of these systems.

Finally, FIGS. 9 and 10 illustrate the invention 10 in the third or vent position wherein the outer end 114 of the actuating lever 110 has been displaced to the far left and the one-piece door 76 has been translated to a position wherein the third section 124 of the wall is in overlying relationship with the exhaust and vent openings 66 and 68. As a result, the system is allowed to operate in the vent mode with air flow through the openings 140 in the lower section 124 thereby allowing flow through the vent opening 68 and the vent flow path as described above. In this position, the upper section 138 closes the vent opening 66 thereby precluding air flow therethrough.

What is claimed is:

1. In a room air conditioner of the type having a partition dividing indoor and outdoor sections and having vent and exhaust openings for exhausting air into the outdoor section and for venting outdoor air into the indoor section, said vent opening and said exhaust opening being in vertically spaced relationship with one another in a substantially planar wall section of said partition, an improved control mechanism comprising:

a combination vent and exhaust door mounted on said partition in the outdoor section, said door comprising a substantially planar wall configured to be mounted to said partition in overlying relation to said vent openings and said exhaust opening, said door being configured to be selectively operable to, a first position wherein a first vertically extending section of said wall overlies said vent and said exhaust openings, whereby said vent opening is closed and said exhaust opening is open;

a second position wherein a second vertically extending section of said wall overlies said vent and said exhaust openings, whereby said vent opening is closed and said exhaust opening is closed; and a third position wherein a third vertically extending section of said wall overlies said vent and said exhaust openings, whereby said vent opening is open and said exhaust opening is closed; and an actuator mechanism mechanically linked to said combination door for selectively operating said door to each of said three positions.

2. The apparatus of claim 1 wherein said combination vent and exhaust door is substantially rectangular in shape and is supported on said partition for horizontal movement between said positions.

3. The apparatus of claim 1 wherein said door has an actuating arm extending from a vertically extending edge thereof, and further including an actuating lever extending from a position on the inside section of said partition, which is configured to engage said actuating arm and to be manually manipulated to horizontally selectively displace said door to each of said three positions.

* * * * *